US012104787B2

(12) United States Patent
Martin et al.

(10) Patent No.: US 12,104,787 B2
(45) Date of Patent: Oct. 1, 2024

(54) GRATE BAR, GRATE BAR ARRANGEMENT, AND METHOD FOR OPERATING A GRATE BAR ARRANGEMENT

(71) Applicant: MARTIN GmbH fuer Umwelt- und Energietechnik, Munich (DE)

(72) Inventors: Ulrich Martin, Munich (DE); Helmut Pupp, Erding (DE); Max Josef Schoensteiner, Munich (DE)

(73) Assignee: MARTIN GmbH fuer Umwelt- und Energietechnik, Munich (DE)

( * ) Notice: Subject to any disclaimer, the term of this patent is extended or adjusted under 35 U.S.C. 154(b) by 0 days.

(21) Appl. No.: 18/235,442

(22) Filed: Aug. 18, 2023

(65) Prior Publication Data

US 2023/0392787 A1 Dec. 7, 2023

Related U.S. Application Data

(62) Division of application No. 17/327,840, filed on May 24, 2021, now Pat. No. 11,906,162.

(30) Foreign Application Priority Data

May 25, 2020 (DE) ..... 10 2020 003 114.5

(51) Int. Cl.
*F23H 17/12* (2006.01)
*F23H 17/08* (2006.01)

(52) U.S. Cl.
CPC ..... *F23H 17/12* (2013.01); *F23H 17/08* (2013.01); *F23H 2900/17002* (2013.01)

(58) Field of Classification Search
CPC ..... F23H 17/12; F23H 17/08; F23H 2900/17002; F23H 17/00; F23H 7/08
See application file for complete search history.

(56) References Cited

U.S. PATENT DOCUMENTS 1,931,003 A 10/1933 Kramaroff et al.
2,879,727 A 3/1959 Walters
(Continued)

FOREIGN PATENT DOCUMENTS

DE 416 243 C 7/1925
DE 28 08 057 C2 2/1980
(Continued)

OTHER PUBLICATIONS

German Search Report dated Dec. 3, 2020 in German Application No. 10 2020 003 114.5 with English translation of relevant parts.
(Continued)

*Primary Examiner* — David J Laux
(74) *Attorney, Agent, or Firm* — Collard & Roe, P.C.

(57) ABSTRACT

A grate bar has a grate bar head, two side walls, a running surface behind the head and between the side walls and an underside disposed below the surface and between the side walls. A recess in one side wall forms an air slot between the surface and underside and is arranged only on one side wall, not in its opposite side wall. In a grate bar arrangement including multiple grate bars, each including a running surface and a grate bar head, in which an upper grate bar with grate bar head is moveably arranged relative to a lower grate bar so that the head may slide over front and rear grate bar running surface areas, the running surface has air slots in the front and rear areas and the head is displaceable relative to these slots so that the opening cross section of all slots remains constant.

11 Claims, 5 Drawing Sheets

(56) References Cited

U.S. PATENT DOCUMENTS

| | | | | | |
|---|---|---|---|---|---|
| 4,239,029 | A | | 12/1980 | Martin et al. | |
| 4,776,287 | A | * | 10/1988 | Moreau | F23H 17/00 110/328 |
| 5,538,128 | A | * | 7/1996 | Stierll | F23H 17/00 198/773 |
| 5,551,356 | A | | 9/1996 | Post | |
| 5,913,274 | A | | 6/1999 | Künzli et al. | |
| 9,038,550 | B2 | * | 5/2015 | Spliethoff | F23H 17/12 110/267 |
| 2013/0167762 | A1 | | 7/2013 | Schmid | |

FOREIGN PATENT DOCUMENTS

| | | | |
|---|---|---|---|
| DE | 196 48 128 | A1 | 5/1998 |
| DE | 198 51 471 | A1 | 5/2000 |
| DE | 199 07 944 | A1 | 9/2000 |
| DE | 10 2009 016 523 | A1 | 11/2010 |
| EP | 0 650 017 | A1 | 4/1995 |
| EP | 2 614 304 | B1 | 3/2016 |
| JP | S53-130204 | U | 10/1978 |
| KR | 2013-0053519 | A | 5/2013 |
| WO | 2012/032490 | A1 | 3/2012 |

OTHER PUBLICATIONS

European Search Report in 21000116.0, dated Oct. 26, 2021, with English translation of relevant parts.

* cited by examiner

GRATE BAR, GRATE BAR ARRANGEMENT, AND METHOD FOR OPERATING A GRATE BAR ARRANGEMENT

CROSS REFERENCE TO RELATED APPLICATIONS

This application is a divisional of and Applicant claims priority under 35 U.S.C. §§ 120 and 121 of U.S. patent application Ser. No. 17/327,840 filed on May 24, 2021, which claims priority under 35 U.S.C. § 119 of German Application No. 10 2020 003 114.5 filed on May 25, 2020, the disclosure of which is incorporated by reference.

BACKGROUND OF THE INVENTION

1. Field of the Invention

The invention relates to a grate bar comprising a grate bar head, two side walls, a running surface behind the grate bar head and between the side walls, and an underside disposed below the running surface and between the side walls, wherein a recess in a side wall forms at least one air slot between the running surface and the underside.

In addition, the invention relates to a grate bar arrangement, comprising at least three grate bars comprising respectively a running surface and a grate bar head, in which an upper grate bar with its grate bar head is arranged to be movable relative to a lower grate bar in such a way that the grate bar head may slide over a front and a rear area of the running surface of the grate bar.

Furthermore, the invention relates to a method for operating a grate bar arrangement comprising multiple grate bars, comprising respectively a running surface and a grate bar head, in which an upper grate bar with its grate bar head is moved relative to a lower grate bar in such a way that the grate bar head slides over a front and a rear area of the running surface of the grate bar.

2. Description of the Related Art

The grate furnace is a solid fuel furnace, in which the fuel lies on a grate and combusts. The grate is a surface provided with openings. The openings in the grate function to guide the air ("under-grate blast") required for the combustion, and the ashes are discharged via a deslagger. The necessary movements for recirculating ("stoking") the fire are carried out automatically in larger grate furnaces by moving the grate.

A step grate/moving grate appears similar to a step that lies flat and has a slope generally between 0 and 30 degrees, for example, 24 or 26 degrees. The fuel is thus moved across the grate in that the steps move and thus transport the fuel. Depending on the direction of the grate bar movement, the step grate is also called an in-feed grate or a reverse feed grate (however, in both cases there is a forward movement for the fuel).

Step grates are used for coarse and high ash fuels, which require an improved stoking, e.g., household and commercial wastes, biomass, treated waste, or also brown coal, which is much more rare today.

Step grates have a plurality of grate bars, which may be fixedly connected to one another or moveable relative to one another in order to move the combustible material on the grate.

Grate bars generally have air slots in a grate bar head in front of the running surface. For this purpose, recesses are provided on the side wall of the grate bar or also in the shape of round openings in the surface, which permit air to be conveyed to the underside of the grate bar and then to leak out through the air slot between the grate bars to the firebed. However, round openings, for example, may also be provided in the surface of the grate bar.

In particular, when treating waste with a high proportion of metal, metal parts may get caught and settle in the air slots in the area of the grate bar head.

In order to prevent this, EP 2 614 304 A1 describes air slots, which are arranged in the side walls of the grate bar in the area of the grate bar head and the running surface. As these air slots are arranged on both sides of the grate bar, recesses, which together form an air slot, lie opposite one another in each case in an installed grate bar. During a relative movement of adjacent grate bars, particles penetrating into the air slots are cut up and thus comminuted in such a way that are conveyed back into the firebed by the air flow in the air slots.

However, this arrangement has the disadvantage that the forces acting on the metal particles in the air slots also result in counterforces, which may affect the individual grate bars and may result in uncontrolled movements of the grate bars and also damages in the area of the air slots.

SUMMARY OF THE INVENTION

Therefore, the object underlying the invention is to further develop known grate bars in such a way that the grate bars are protected in practical operation and achieve a defined ventilation of the firebed.

This problem is solved by a generic grate bar, in which the at least one air slot is arranged only on one side wall and is not arranged in the opposite side wall.

By this means, by arranging air slots are only on one side wall, particles are excluded from penetrating into the area of opposite air slots and are exposed to shear stresses, which act on at least one grate bar. The arrangement of the air slots in the area of the running surface and not in the area of the grate bar head already ensures that a superincumbent grate bar, which slides on the running surface, exerts a force on the metal particles which get caught in an air slot.

The shearing stress thus does not act substantially between two adjacent grate bars, but instead between an underlying grate bar, in which if applicable particles may penetrate into the air slot, and a superincumbent grate bar, which slides on the running surface and thus also pushes out particles penetrating into an air slot.

The overrunning of the air slots arranged in the running surface by the grate bar head of the superincumbent grate bar ensures that the air slot sometimes lies in the firebed and sometimes is covered by the superincumbent grate bar. This reduces thermal wear on the air slot. In addition, the overrunning of the air slot by the grate bar head of the superincumbent grate bar head also leads to the fact that the running surface is cleaned, or at least pushed clear. The upper side of the air slot is also thereby cleaned. The fire is fanned by the supplied air in the area of the air slots. By this means, so-called forge fire may occur, which leads to thermal wear, in particular in the area of the air slots. A particular advantage now lies in that this forge fire is extinguished by the upper grate bar head passing over. The air slots are actually covered temporarily by the grate bar head moving across, so that they may actually cool off somewhat. However, the air slots thus overrun may also cool more, as the combusting material disposed thereon is also pushed away.

As, according to the invention, the superincumbent grate bar frees the air slots from particles caught therein in the area of the running surface of the underlying grate bar, it is further proposed that the side wall has at least one air slot only in the area of the running surface. Therefore, the grate bar no longer has any air slots in the area of the grate bar head, and either one air slot is provided in the area of the running surface or multiple air slots are provided one behind the other, wherein preferably two air slots are provided one behind the other in the area of the running surface.

If no air slots are arranged in the area of the grate bar head, then no air slots are pushed into the firebed by the grate bar head. This prevents material, in particular metal particles, from being pressed into air slots in the grate bar head when the grate bar head enters into the firebed.

In order to even further reduce the risk of catching metal parts in the air slots of the grate bar, it is proposed that the air slot has a cross-sectional area which expands from the running surface to the underside. The air slot thus expands from the overlying running surface to the underlying underside, and this leads to the fact that particles, which arrive into the air slot from the firebed and thus from the running surface, may fall downward through the air slot when they are pressed or comminuted by a grate bar guided across the running surface.

For this purpose, a cutting edge, which facilitates the comminuting of a particle arriving into the air slot, may also lie between the running surface and the enlarged area of the cross-sectional area located therebelow.

An air slot is generally designed with a front side, transverse to the extension of the grate bar, and an opposite rear side, and a side wall lying therebetween. It is advantageous in this case if the front, rear, and/or side wall is/are arranged at an acute angle to the running surface, so that the cross-sectional area expands directly under the running surface and an edge is created on the running surface which promotes the cutting of particles.

In practice, the lower end of the grate bar head lies on the running surface of an underlying grate bar, and the sliding surface of the upper grate bar head thereby contacts the running surface of the underlying grate bar. This sliding surface may have a spacer, which is shaped so that it acts with a defined force on particles that lie on the running surface or, if applicable, have penetrated somewhat into the air slots.

The spacer may correspondingly have, as a cutting edge, a contact surface, extending to the sliding surface at an acute angle, or in a curve with a radius of less than 200 mm and in particular a circular sector of less than 80°. This cutting edge may be arranged at the front end of the sliding surface in the longitudinal direction of the grate bar, in order to cut up, scrape, or push forward material from the surface of an underlying grate bar during an advance of the grate bar across a running surface of the underlying grate bar.

However, this cutting edge may also be arranged at the rear edge of the sliding surface in order to clean the surface of an underlying running surface, across which the sliding surface of the superincumbent grate bar is pulled, during a retraction of the upper grate bar relative to the running surface of the underlying grate bar. The grate bar head thus preferably has two cutting edges, which respectively clean the running surface of an underlying grate bar during the advance and during the retraction of the grate bar.

The sliding surface of the grate bar may, however, also have a spacer which has, as a pushing edge, a contact surface, extending to the sliding surface at an obtuse angle, or in a curve with a radius of more than 200 mm and in particular a circular sector of more than 100°. This pushing edge may also be designed on the front area of the sliding surface and/or at the rear area of the sliding surface, in order, in the case of debris lying on the running surface of the underlying the grate bar head, to allow the sliding surface of the grate bar head to securely slide over these types of deposits.

One particularly preferred embodiment has a cutting edge in the front area of the sliding surface and a pushing edge in the rear area of the sliding surface. Depending on the embodiment of the grate and depending on the material to be combusted, the grate bar may have a cutting edge or a pushing edge at different points, and different grate bars may also be combined in order to use the respectively optimal grate bar in different combustion areas, said grate bar having pushing and cutting edges adapted to the area. This allows for grate bars, individually adapted to the combustion process, which lead to an optimal combustion.

The grate bar according to the invention, independently from the previously listed features, may also have a latch, which has one or two parts. A one-part latch is understood to be a latch, which is not molded or welded on, but instead is a detachable part as a latch. This latch may be arranged positively or non-positively on a side wall of the grate bar. For example, it may have a head, which is inserted into an elongated hole and fixed by turning.

The latch preferably has two parts and, in particular, is formed as a combination of a screw and nut. Therefore, it is proposed that the latch of the grate bar has a screw. This facilitates an easy disassembly of grate bars, in particular in the edge area of the firebed. The screwable nuts may thereby lie below the running surface or outside adjacent to the running surface. The screw head preferably lies outside and the nut lies protected under the running surface.

One particular embodiment variant provides that the screw of the latch has a head which has a polygonal socket. The screw may then be, for example, a so-called Allen screw, a hexagonal socket screw, or a square socket screw. The head of the screw preferably lies on a side wall in such a way that it projects outward past the side wall and takes on the function of the latch, while the nut is arranged underneath the running surface and only functions to hold the screw, and, if applicable, to replace the screw.

In the case of a detachable latch, the head of the latch has the function of the known latch, as this head may engage in a latch window of an adjacent grate bar. It is advantageous if this head has a round cross section, as then no interfering material may collect on the latch. The round surface of the latch no longer forms a plane on which interfering material agglomerates.

A grate bar may also have multiple latches at different points of the grate bar. However, it is advantageous if the grate bar has only one latch, as then problems arising at the latch are reduced to one problem area.

While the prior art generally included, fixtures, like cooling ribs, arranged on the underside of the grate bar; it is proposed that the underside is substantially flat between the side areas in the area of the latch. By this means, a mating piece of the latch, for example a nut, may be arranged to be easily accessible, and the entire grate bar requires less material and ultimately has less weight.

Another advantageous feature of the grate bar is that it has a latch window, into which a latch of an adjacent grate bar may engage, and which has an opening on the side opposite the running surface. This embodiment is conceived of for the edge bars, as it is not necessary to hold the grate bar down there, i.e., to secure it against lifting.

The latch window thus as a lower opening, through which material arriving into the latch window may fall down again out of the latch window.

The feature that the grate bar has a core rod, which is embedded into the grate bar, is essential to the invention and also independent of the previously listed features. It is indeed known to make grate bars from different materials. These grate bars have a specific material on the running surface, while the remaining grate bar is produced from another material. This facilitates particularly stable running surfaces.

However, a core rod embedded in the grate bar has a different function. It may be designed to be particularly ductile, so that, in the case a bar breaks, it does not likewise break, or at least holds the broken pieces of the bar together so that the bar does not fall apart. By this means, the grate may still be operated, even in the case of a broken grate bar, until the next controlled idle time, without the grate lacking a broken bar, which has fallen into the underlying waste collector.

A grate bar is not used during operation of a furnace plant as a single grate bar, but instead as a grate bar arrangement comprising multiple grate bars. An upper grate bar with its grate bar head is thereby arranged to be movable relative to a lower grate bar in such a way that the grate bar head may slide over a front and a rear area of the running surface of the grate bar.

KR 2013-0053519 A describes a grate bar arrangement of both channels supplying air outlet openings with air. The alignment could also be operated with very small movements of the moving grate bars. It is not mentioned, however, how far the movable grate bars are being pushed ahead or could be pushed ahead.

It is thus advantageous in this type of grate bar arrangement if the running surface has air slots in the front and the rear areas, and the grate bar head is displaceable relative to these air slots in such a way that the opening cross section of all ventilation slots remains constant.

This means that, due to the displacement of the grate bars relative to each other, all air slots of the underlying grate bar are sometimes covered by the superincumbent grate bar, sometimes only the front air slots and sometimes no air slots are covered by the superincumbent grate bar. By this means, initially more or less air flows through the underlying grate bar. However, as more or fewer air slots on the superincumbent grate bar are also covered by this superincumbent grate bar during the movement of the grate bar, the opening cross section of all air slots is constant in the arrangement according to the invention.

In the case of a grate with multiple superincumbent rows of grate bars, many areas thus arise, in which a grate bar arrangement comprising multiple grate bars is present, which are arranged and movable so that the opening cross section of all ventilation slots of this grate bar arrangement remains constant. The arrangement of the air slots is carried out in such a way that the same free area is always available for air flow, an alternating air distribution results, and leads to a stable heating. The relative stroke of the superincumbent grate bars leads to air slots that may be overrun and to a cutting free of interfering particles that may collect in the area of the air slots.

Grate bars arranged above one another are thereby movable toward each other and grate bars arranged adjacently may either be movable relative to one another or also be fixedly screwed to one another.

As relates to method, the underlying object of the invention is solved by a method for operating a grate bar arrangement comprising multiple grate bars comprising respectively a running surface and a grate bar head, in which an upper grate bar with its grate bar head is moved relative to a lower grate bar in such a way that the grate bar head slides over a front and a rear area of the running surface of the grate bar. The running surface thereby has air slots in the front and the rear areas, and the grate bar head is displaced relative to these air slots in such a way that the opening cross section of all ventilation slots remains constant. This grate bar arrangement does not have to contain all grate bars of the furnace system. It is sufficient if, in one area of multiple grate bars arranged above one another, these grate bars are thus arranged and provided with air slots in such a way that the opening cross section of all ventilation slots also remains substantially constant also during operation.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
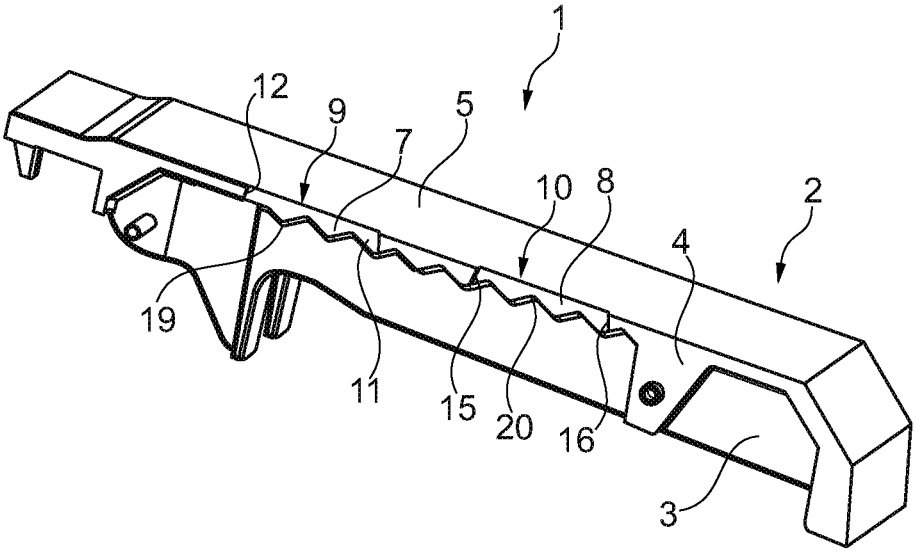
FIG. 1 shows a grate bar with a front and a rear latch.
Figure 2:
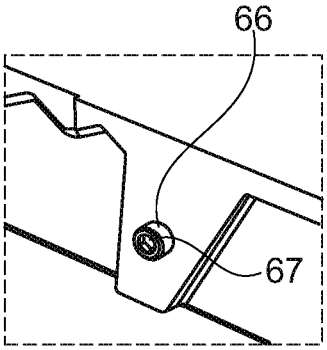
FIG. 2 shows an enlarged depiction of the front latch shown in FIG. 1.
Figure 3:
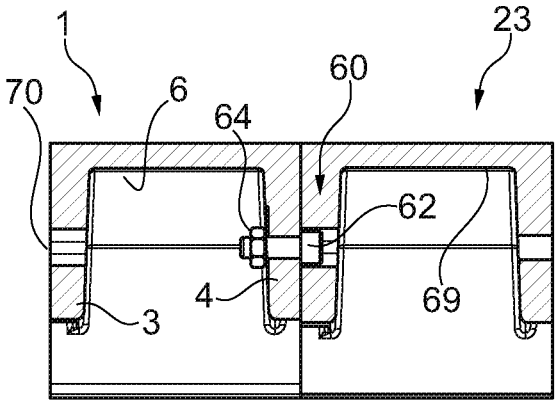
FIG. 3 shows a sectional view through two grate bars in the area of the latch shown in FIG. 2.
Figure 4:
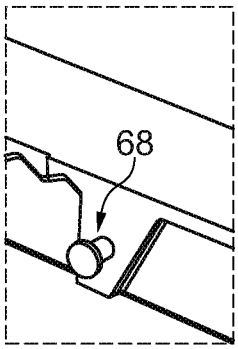
FIG. 4 shows an enlarged depiction of an alternative embodiment of the latch shown in FIG. 2.

Grate bar 1, shown in FIG. 1, has a grate bar head 2, two side walls 3 and 4, and a running surface 5. Grate bar head 2 lies in a front area of grate bar 1 and running surface 5 lies therebehind in a rear area of grate bar 1. Underside 6 of grate bar 1 lies under running surface 5 and between side walls 3 and 4.

Recesses 7 and 8 in side wall 4 are on one side of grate bar 1 in the area of running surface 5. These laterally arranged recesses 7 and 8 form air slots 9, 10 extending from underside 6 to running surface 5 in a view transverse to this.

Air slots 9 and 10 are only arranged in the area of running surface 5 and not in the area of grate bar head 2. By this means, air slots 9, 10 are completely overrun by a grate bar head of another grate bar pushed on running surface 5.

Front flank 11 and rear flank 12 of air slot 9 are each arranged at an acute angle to running surface 5 so that cross-sectional area 13 (see FIG. 6) expands from running surface 5 to underside 6 of grate bar 1.

Figure 12:
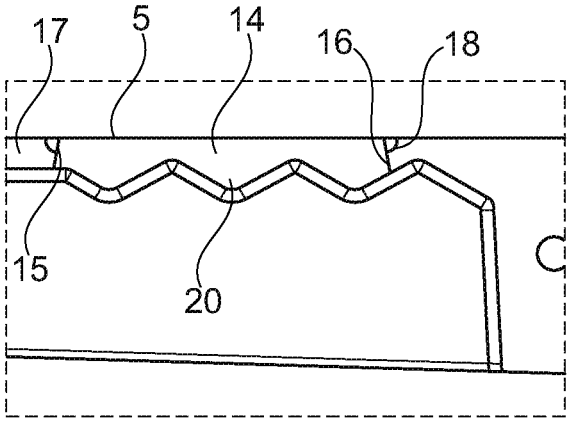
FIG. 12 shows a schematic longitudinal section through the area of the grate bar shown in FIG. 11.
Figure 13:
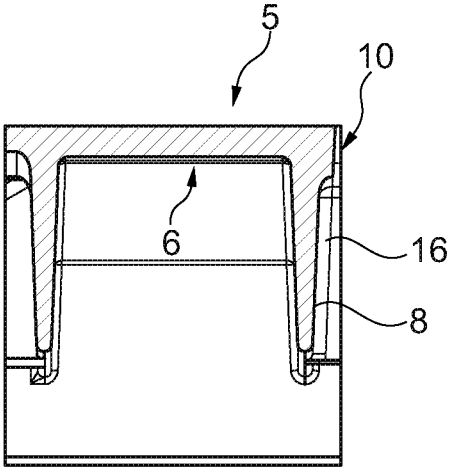
FIG. 13 shows a schematic cross section through the area of the grate bar shown in FIG. 11.
Figure 14:
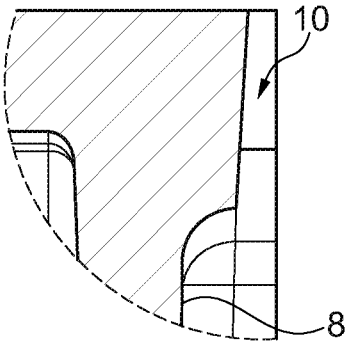
FIG. 14 shows an enlarged, schematic detail from FIG. 13.

Correspondingly, flanks 15, 16 of air slot 10 are arranged at an acute angle 17, 18 to running surface 5—as shown in FIG. 12—so that cross sectional surface 14 of air slot 10 also expands from running surface 5 to underside 6.

The expansion of cross sections 13 and 14 from running surface 5 to underside 6 of grate bar 1 is also increased in that recesses 7 and 8 between flanks 11 and 12 or 15 and 16 are arranged at an acute angle to running surface 5 in such a way that cross-sectional areas 13, 14 of air slots 9, 10 expand from running surface 5 to underside 6.

Figure 6:
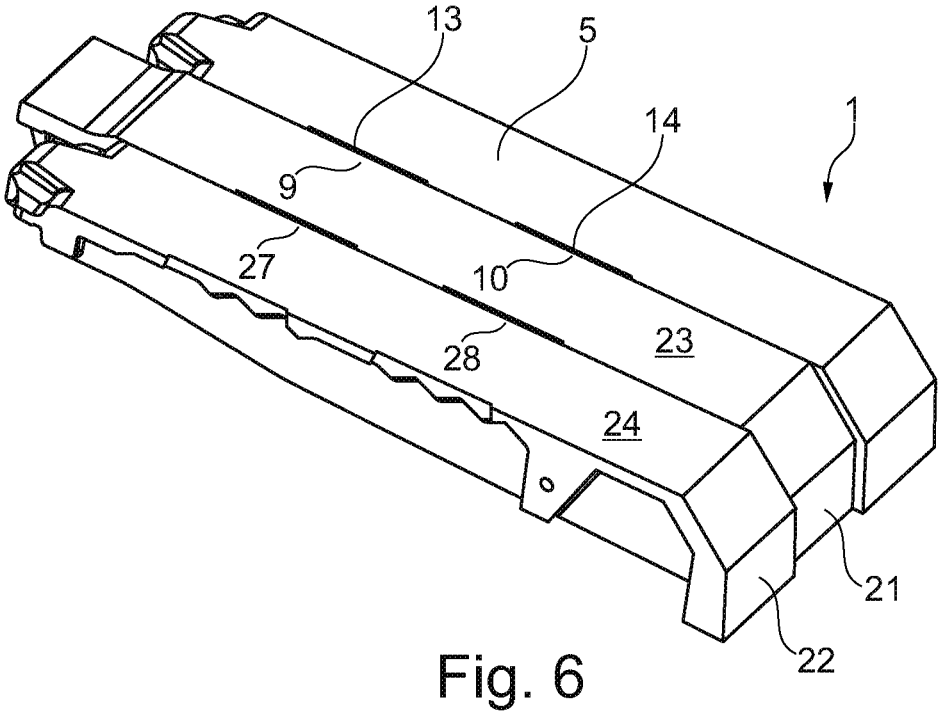
FIG. 6 shows a view of a grate bar arrangement with three adjacent grate bars.

FIG. 6 shows how multiple grate bars 1, 21, 22 are arranged adjacently in order to provide running surfaces 5, 23, 24 substantially in one plane with air slots 25 to 28 lying therebetween.

Figure 7:
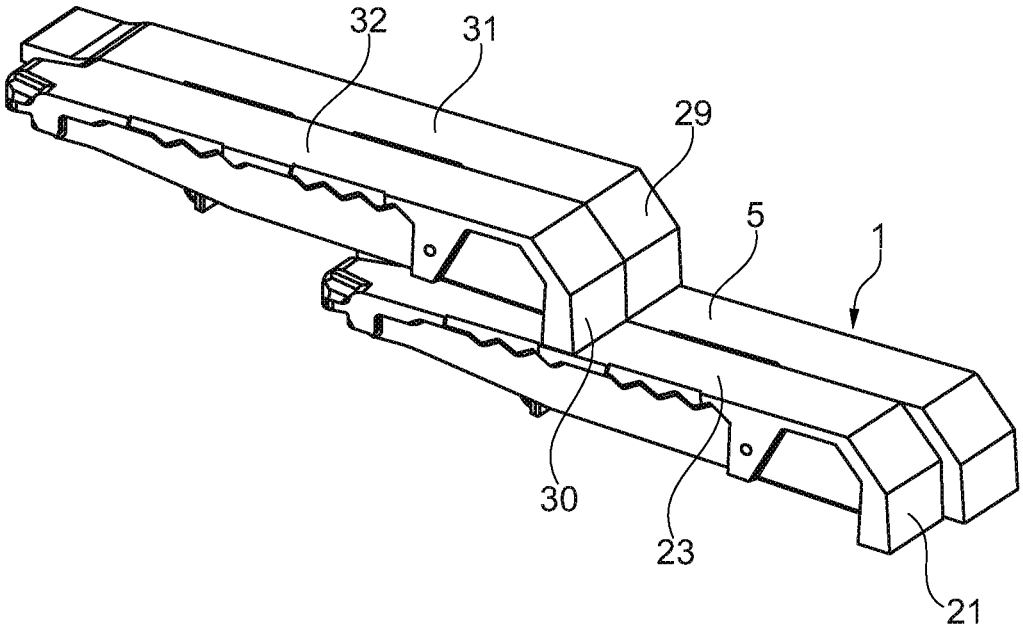
FIG. 7 shows a view of a grate bar arrangement with two grate bars arranged adjacently and two grate bars arranged above one another in each case.

FIG. 7 shows how grate bar heads 29 and 30 of other grate bars 31 and 32 slide along running surfaces 5 and 23 of grate bars 1 and 21. Grate bar heads 29 and 30 thereby move across air slots 9, 10, and 27 and 28 of grate bars 1 and 21 in order to push material of the firebed disposed on running surfaces 5 and 23 away from air slots 9, 10, and 27 and 28.

Figure 8:
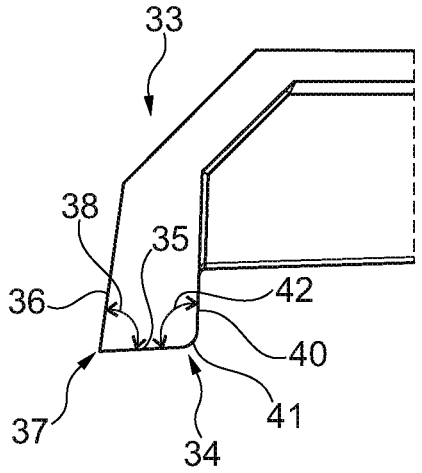
FIG. 8 shows a sectional view through a grate bar head with a cutting edge in front and a pushing edge in back.
Figure 9:
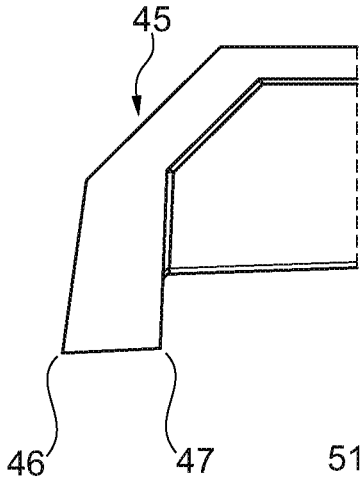
FIG. 9 shows a sectional view through a grate bar head with a cutting edge in front and an elevated cutting edge in back.
Figure 10:
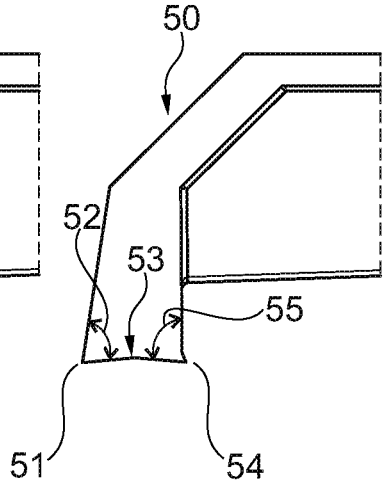
FIG. 10 shows a sectional view through a grate bar head with a cutting edge in front and a downward-facing cutting edge in back.
Figure 11:
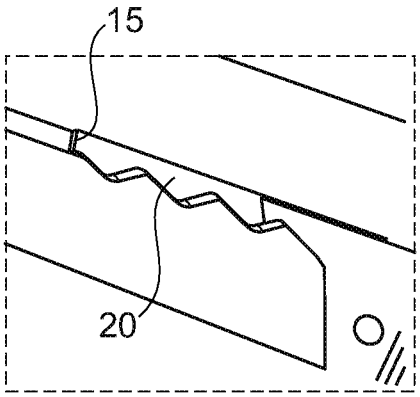
FIG. 11 shows a schematic section from FIG. 1 with the front air slot.

For this purpose, the front end of grate bar head 2, 29, 30 has a specialized shape, which may be designed according to the intended use and area of application, as is shown in cross section in FIGS. 8, 9, and 10.

Grate bar head 33 shown in FIG. 8 has a lower end 34 comprising a sliding surface 35 which has a cutting edge 37 on the front end of grate bar head 33. This cutting edge 37 has an acute angle 38 between sliding surface 35 and pushing surface 36.

When pulling the grate bar head back, inner side 40 functions as a spacer, which is designed in the exemplary embodiment shown in FIG. 8 as a pushing edge 41 transitioning into sliding surface 35. This pushing edge 41 has an obtuse angle 42 between sliding surface 35 and pushing surface 40. While FIG. 8 has a curve with a radius of approximately 6 mm and a circular sector of approximately 105° as pushing edge 41, FIG. 9 shows a cutting edge 46 on grate bar head 45—like in FIG. 8—and a pushing edge 41 shaped in cross section as a corner with an obtuse angle.

FIG. 10 shows a grate bar head 50 comprising a cutting edge 51 with an acute angle 52 in the front area of sliding surface 53 and another cutting edge 54 with an acute angle 55 in the rear area of sliding surface 53 of grate bar head 50.

Figure 5:
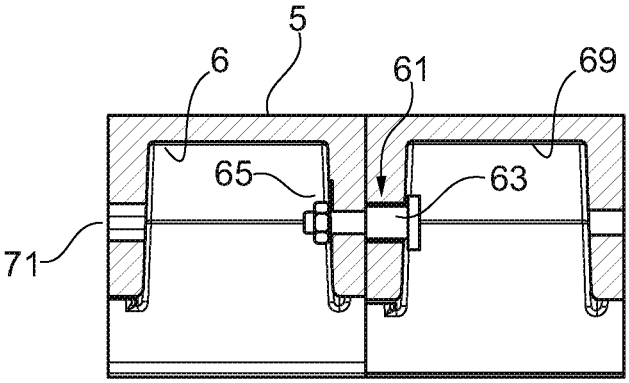
FIG. 5 shows a sectional view through two grate bars in the area of the latch shown in FIG. 4.

FIGS. 2 to 5 show two-part latches 60, 61, which each comprise a screw 62, 63 and a nut 64, 65. Screw 62 has a screw head 66 with polygonal socket 67 and screw 63 has a mushroom shape as screw head 68. In both cases, latch 60, 61 has a latch head with a round cross section, which is either arranged in the wall of the adjacent grate bar (FIG. 3) or is arranged underneath underside 69 of the adjacent grate bar (FIG. 5). Undersides 6 and 69 of adjacent grate bars 1 and 23 are substantially flat between side walls 3 and 4 in the area of latches 60 and 61, so that screws 62 and 63 and nuts 64 and 65 are easily accessible.

Each grate bar 1, 23 has a latch window 70, 71 on a side wall 3 and a latch 60, 61 on opposite side wall 4, so that in the case of adjacent grate bars 1, 23, each latch 60, 61 may engage in latch window 70, 71 of the adjacent latch. Latch window 70, 71 may accommodate latch 60, 61 of the adjacent grate bar in the upper region, and have an opening (not shown) on its side opposite running surface 5.

The grate bar shown in FIGS. 18 to 21 has only one single latch 66 and a core rod 80 is embedded into grate bar 1. This embedded core rod 80 lies under the running surface in such a way that it does not contact the running surface. Embedded means that the core rod is preferably entirely surrounded by the remaining material of the grate bar, and is thus completely encased by the other material.

Figure 21:
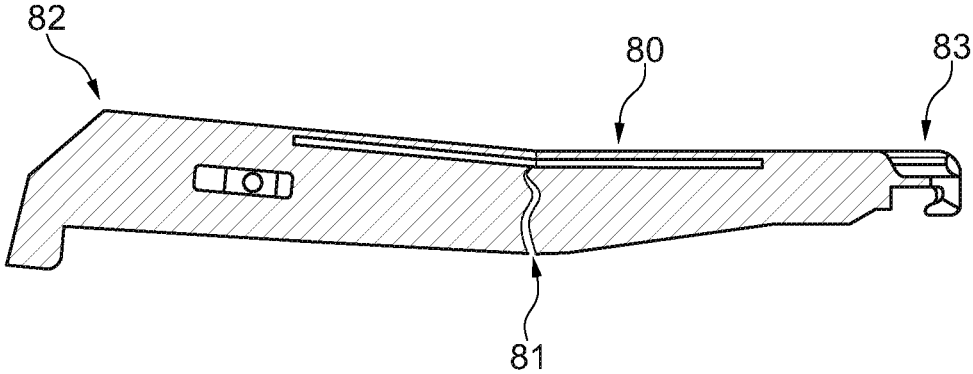
FIG. 21 shows the grate bar shown in FIG. 20 in a broken state.

FIG. 21 shows how core rod 80 flexes in case of a break of grate bar 1, and how, in the case of a gap 81 occurring during the break, it bridges this gap 81 and holds broken parts 82, 83 of grate bar 1 together.

Figure 15:
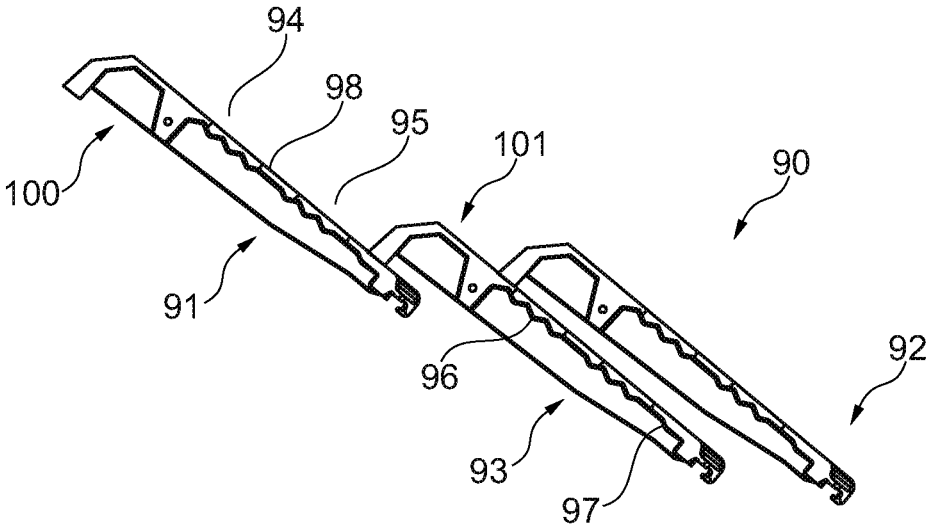
FIG. 15 shows a grate bar arrangement with a movable grate bar in the lowest position.
Figure 16:
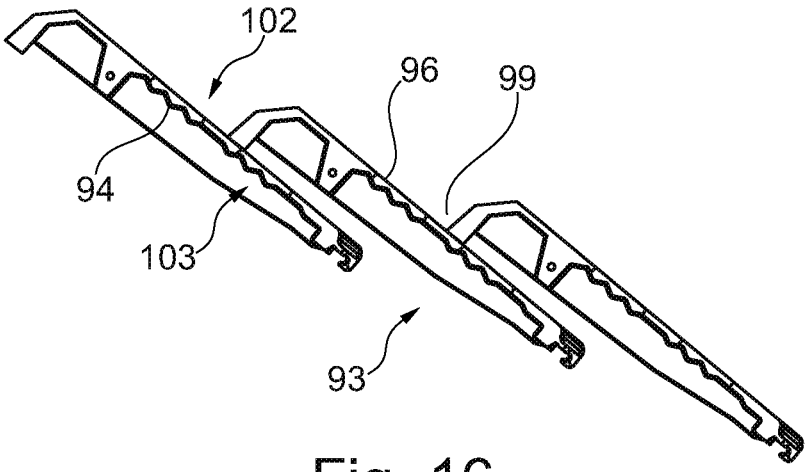
FIG. 16 shows the grate bar arrangement shown in FIG. 15 with the movable grate bar in a center position.
Figure 17:
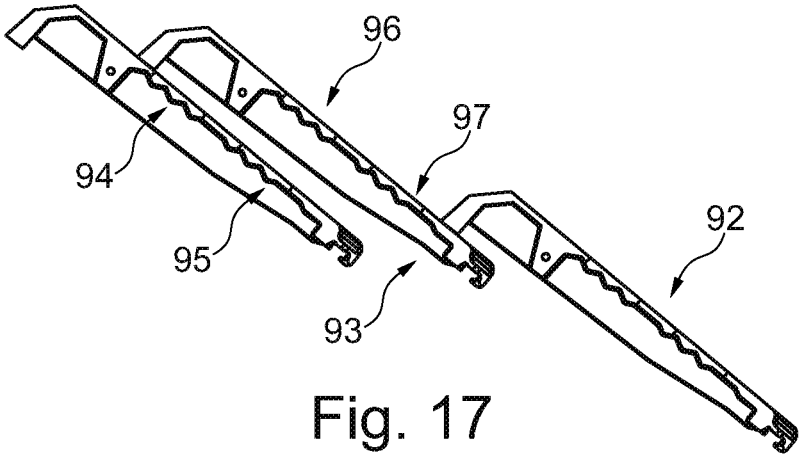
FIG. 17 shows the grate bar arrangement shown in FIG. 15 with the movable grate bar in the highest position.
Figure 18:
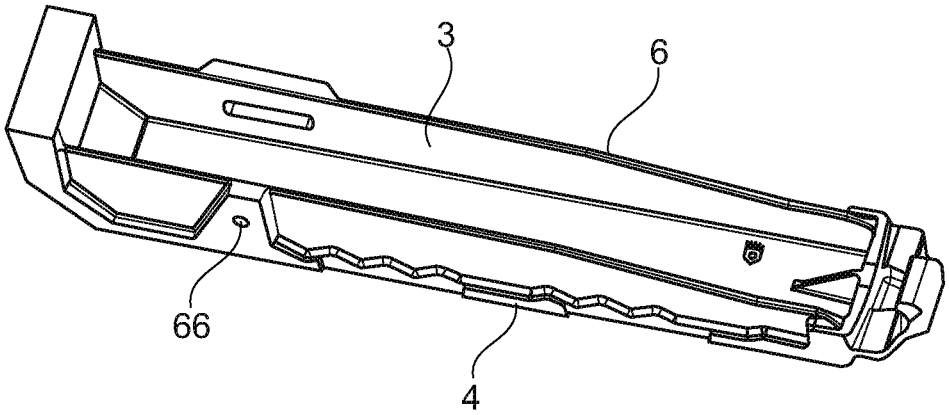
FIG. 18 shows the underside of a grate bar.
Figure 19:
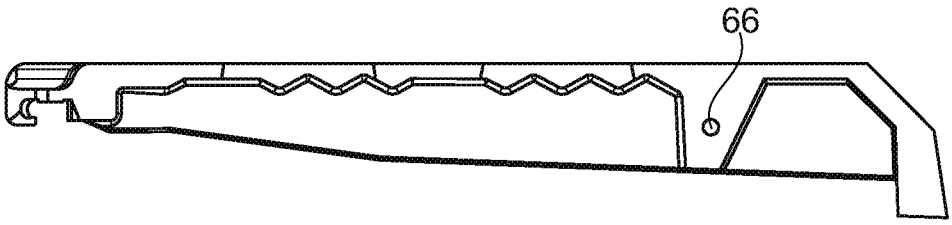
FIG. 19 shows a longitudinal section through the grate bar shown in FIG. 18.
Figure 20:
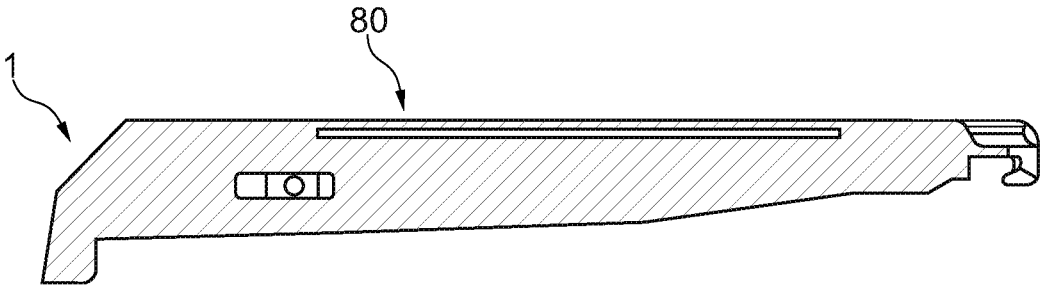
FIG. 20 shows a core rod schematically embedded into a grate bar.

FIGS. 15 to 17 show a grate bar arrangement 90 with two fixed grate bars 91 and 92 and one grate bar 93 arranged moveably therebetween. It is clear in FIGS. 15 to 17 how movable grate bar 93 may be pushed between fixed grate bars 91 and 92 from the lower position, shown in FIG. 15, through the center position, shown in FIG. 16, to the upper position, shown in FIG. 17.

The arrangement and the shape of the grate bars are configured so that, regardless of the position of moveable grate bar 93, the opening cross section of all air slots 94 to 97 remains constant. For this purpose, grate bars 91 and 93 have a running surface 98, 99 and in each case a grate bar head 100, 101, and grate bar 93 with its grate bar head 101 is arranged as the upper grate bar to be movable relative to grate bar 91, which functions as the lower grate bar. When pushing upper grate bar 93 across lower grate bar 91, grate bar head 101 slides across a front area 102 and a rear area 103 of running surface 98 of grate bar 91. Air slot 95 in rear area 103 is thereby initially overrun by grate bar head 101 of grate bar 93, so that air slot 95 is subsequently covered by grate bar head 101 of grate bar 93, as shown in FIG. 16. However, air slot 96 in grate bar 93 is thereby released, which was previously covered by grate bar 92. Thus, air slots 94 and 95 are open in the grate bar position shown in FIG. 15, while air slots 94 and 96 are open in the position shown in FIG. 16.

FIG. 17 shows grate bar 93 pushed completely upward, which now covers both air slot 95 and also air slot 94 of grate bar 91. Air slots 96 and 97 of moveable grate bar 93 are hereby released, so that two air slots are again open in this position of moveable grate bar 93 as well.

This example of a grate bar arrangement shows how the arrangement of air slots 94, 95, 96, 97 in the area of running surfaces 98, 99 makes it possible to always ensure that the opening cross section of all air slots remains constant during the movement of the grate bars.

Although only a few embodiments of the present invention have been shown and described, it is to be understood that many changes and modifications may be made thereunto without departing from the spirit and scope of the invention.

What is claimed is:

1. A grate bar arrangement (90) comprising at least three grate bars (91, 92, 93) each comprising a running surface (98, 99) and a grate bar head (100, 101), in which arrangement an upper grate bar (93) with its grate bar head (101) is arranged to be movable relative to a lower grate bar (91) in such a way that the grate bar head (101) may slide over a front area (102), and a rear area (103) of the running surface (98, 99) of the grate bar (91), wherein the running surface (98, 99) has air slots (94, 95, 96, 97) in the front and rear areas (102, 103) and the grate bar head (100, 101) is displaceable relative to these air slots (94, 95, 96, 97) in such a way that the opening cross section of all air slots (94, 95, 96, 97) remains constant.

2. The grate bar arrangement according to claim 1, wherein adjacently arranged grate bars (1, 21, 22) are movable relative to one another.

3. The grate bar arrangement according to claim 1, wherein adjacently arranged grate bars (1, 23) are fixedly screwed to one another.

4. The grate bar arrangement according to claim 1, wherein each grate bar (1) is designed with a grate bar head (2), two side walls (3, 4), a running surface (5) behind the grate bar head (2) and between the side walls (3, 4) and an underside (6) disposed below the running surface (5) and between the side walls (3, 4), wherein precisely two recesses (7, 8) in one side wall (4) between the running surface (5) and underside (6) form the air slots (9, 10) due to an interaction of two structurally identical grate bars, wherein the air slots (9, 10) are arranged only on one side wall (4) and not in its opposite side wall (3).

5. The grate bar arrangement according to claim 4, wherein the side wall (4) of each grate bar (91, 92, 93) has air slots (9, 10) only in the area of the running surface (5).

6. The grate bar arrangement according to claim 4, wherein each air slot (9, 10) has a cross-sectional area (13) which expands from the running surface (5) to the underside (6).

7. The grate bar arrangement according to claim 4, wherein each grate bar head (2, 33) has, as a lower end (34), a sliding surface (35) with a cutting edge (37) which has an acute angle (38) or a curve with a radius of less than 200 mm and in particular a circular sector of less than 80° between the sliding surface (35) and pushing surface (36).

8. The grate bar arrangement according to claim 4, wherein each grate bar head (2) has, as a lower end, a sliding surface (35) with a pushing edge (41) which has an obtuse angle (42) or a curve with a radius of more than 200 mm and in particular a circular sector of more than 100° between the sliding surface (35) and pushing surface (40).

9. The grate bar arrangement according to claim 4, wherein each grate bar (91, 92, 93) has a core bar (80), which is embedded into the grate bar (1).

10. A method for operating a grate bar arrangement comprising at least three grate bars (91, 92, 93) each comprising a running surface (98, 99) and a grate bar head (100, 101), in which arrangement an upper grate bar (93) with its grate bar head (101) is arranged to be movable relative to a lower grate bar (91) in such a way that the grate bar head (101) slides over a front area (102) and a rear area (103) of the running surface (98, 99) of the grate bar (91), wherein the running surface (98, 99) has air slots (94, 95, 96, 97) in the front and rear areas (102, 103) and the grate bar head (100, 101) is displaceable relative to these air slots (94, 95, 96, 97) in such a way that the opening cross section of all air slots (94, 95, 96, 97) remains constant.

11. The method according to claim 10, wherein, due to the displacement of the grate bars (91, 92, 93) relative to one another, all air slots (94, 95, 96, 97) of a lower-lying grate bar (91) are temporarily covered by the grate bar (93) lying thereabove, only the air slots (94, 96) in the front area (102) are temporarily covered by the grate bar (93) lying thereabove, and absolutely no air slots (94, 95, 96, 97) are temporarily covered by the grate bar (93) lying thereabove, such that initially more or less air flows through the lower-lying grate par (91), while more or fewer air slots (94, 95, 96, 97) are also covered at the grate bar (93) lying thereabove by the grate bar (92) arranged in turn over the same during the movement of the grate bar (93).

* * * * *